United States Patent [19]

Adams

[11] 4,254,826

[45] Mar. 10, 1981

[54] MODULAR HEAT EXCHANGER

[75] Inventor: Charles L. Adams, Fort Worth, Tex.

[73] Assignee: PVI Industries Inc., Fort Worth, Tex.

[21] Appl. No.: 74,554

[22] Filed: Sep. 11, 1979

[51] Int. Cl.[3] ..... F28F 9/26; F28D 7/10

[52] U.S. Cl. ..... 165/143; 165/145; 165/155; 165/158; 165/165

[58] Field of Search ..... 165/143, 144, 145, 154, 165/155, 157, 158, 159, 162, 164, 165, 166, 167

[56] References Cited

U.S. PATENT DOCUMENTS

| | | | |
|---|---|---|---|
| 3,018,090 | 1/1962 | Kaase et al. | 165/143 |
| 3,101,930 | 8/1963 | Hugt | 165/157 |
| 3,316,961 | 5/1967 | Dorner | 165/145 |
| 3,507,323 | 4/1970 | Ronnholm | 165/145 |
| 3,566,502 | 3/1971 | Pasqualini | 165/143 |
| 3,568,764 | 3/1971 | Newman | 165/158 |
| 3,612,174 | 10/1971 | Vogt | 165/154 |
| 3,712,272 | 1/1973 | Carnavos et al. | 165/157 |
| 3,907,026 | 9/1975 | Mangus | 165/164 |
| 4,190,101 | 2/1980 | Hartmann | 165/158 |
| 4,197,907 | 4/1980 | Smith | 165/158 |

*Primary Examiner*—James C. Yeung
*Assistant Examiner*—Daniel O'Connor
*Attorney, Agent, or Firm*—Robert A. Felsman

[57] ABSTRACT

A heat exchanger has a modular construction to create uniformity among several of its components. The heat exchanger utilizes concentric tubes, with one fluid flowing through the inner tube, and the other fluid flowing through the annular space in the outer tube. The inner tube fluid flows back over the outer tube, further exchanging heat, as it is discharged. The heat exchanger includes four cup-shaped modules that nest or slide together. Each module includes a sleeve with a port for one of the fluids. Each module also has a convex portion that slides sealingly into an adjacent module and contains holes for the tubes. The tubes are sealed into the holes in the convex portions, causing each module to define one of the four manifolds necessary for the operation of the heat exchanger.

10 Claims, 2 Drawing Figures

MODULAR HEAT EXCHANGER

BACKGROUND OF THE INVENTION

1. Field of the Invention

This invention relates in general to heat exchangers, and in particular to a concentric tube heat exchanger containing modular components.

2. Description of the Prior Art

In U.S. Pat. application Ser. No. 795,204, filed May 9, 1977, a heat exchanger for exchanging heat between two fluids is disclosed. The heat exchanger disclosed uses concentric tubes, with one fluid passing through the inner tube and the other fluid passing through the annular space in the outer tube. Manifolds and ports are positioned so that the inner tube fluid exits at one end and flows back over a substantial part of the outer tubes to the discharge port. This causes further exchange of heat. Also, the constricted passages in the inner and outer tubes create high velocity fluid movement, further enhancing heat exchange.

While this exchanger has good characteristics, it requires four manifolds to handle the intake and discharge of the two fluids. Improvements providing more uniform components and simpler construction would make the heat exchanger less expensive and more reliable.

SUMMARY OF THE INVENTION

It is accordingly a general object of this invention to provide an improved heat exchanger for exchanging heat between fluids.

It is a further object of this invention to provide an improved heat exchanger using concentric tubes and construction features such as modular components that reduce manufacturing costs.

In accordance with these objects, a heat exchanger is provided that uses four cup-shaped modules of similar configuration. The modules are constructed to nest within each other during assembling. The modules on the ends have closed caps. The first three modules have convex partitions that contain holes for the concentric tubes to pass through. Each of the four modules has a port for passage of one of the fluids. The tube lengths are selected so that the first module preferably defines the intake for the first fluid. The second module, between its partition and the partition of the first module, defines a manifold for second fluid. The third module, between its partition and the partition of the second module, defines the other manifold for the second fluid. The fourth module, between its cap and the partition of the third module, defines the discharge manifold for the first fluid.

DESCRIPTION OF THE PREFERRED EMBODIMENT

Figure 1:
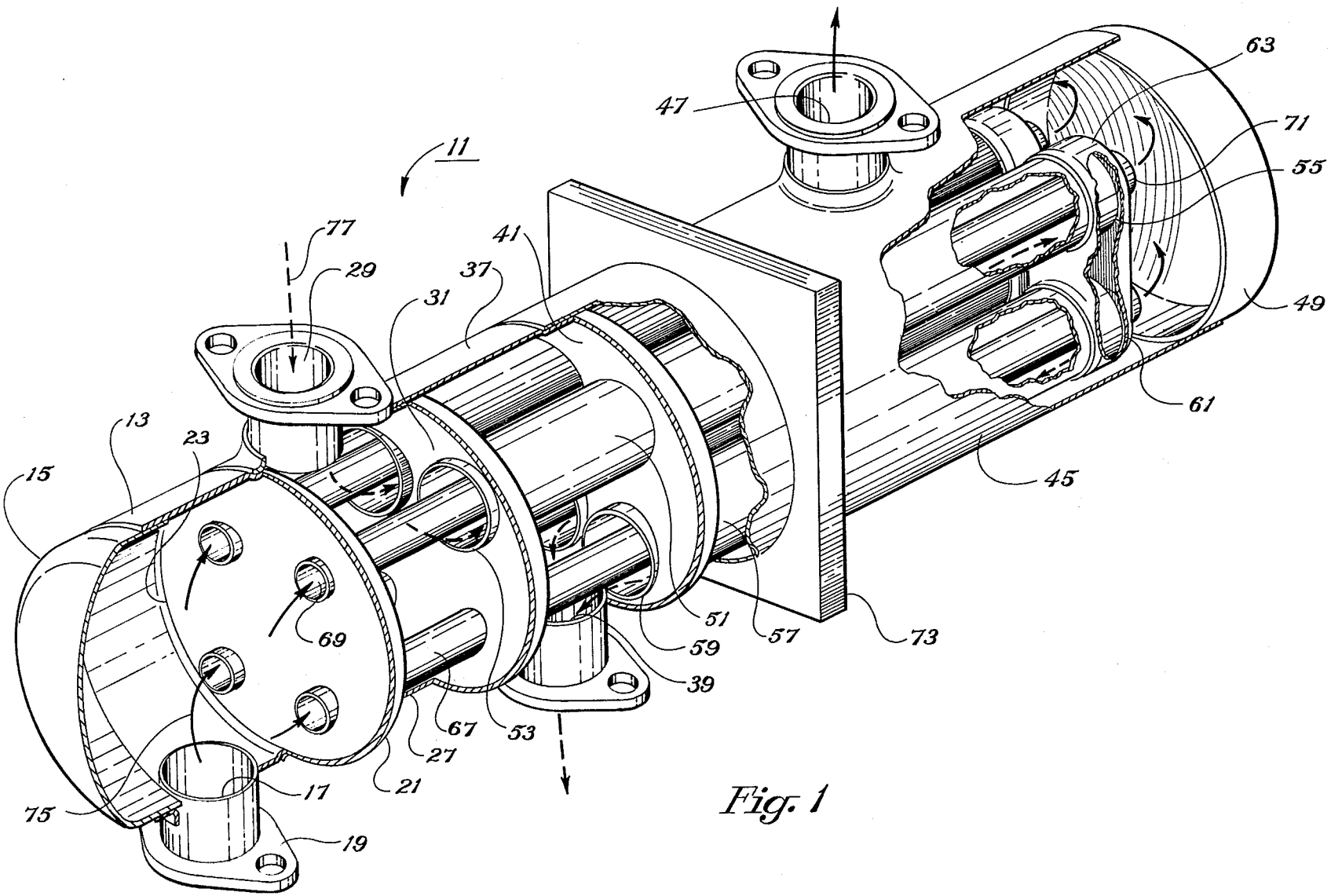
FIG. 1 is a perspective view, partially broken away, of a heat exchanger constructed in accordance with this invention.
Figure 2:
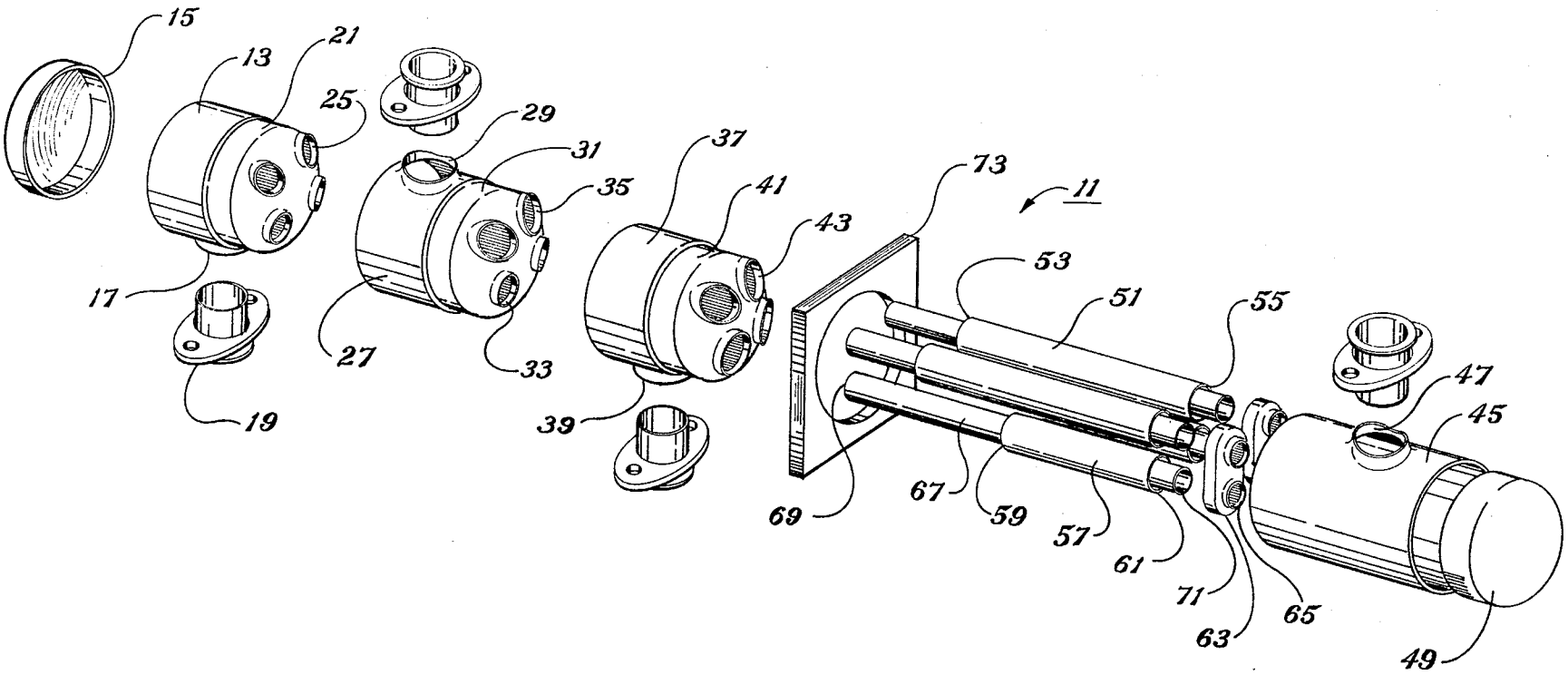
FIG. 2 is a partially exploded perspective view of the heat exchanger of FIG. 1.

Referring to FIG. 1, heat exchanger 11 has a first cylindrical sleeve 13. A cap or plug 15 is sealingly secured within the first end of the sleeve 13. A first port 17 is formed through the side wall of the sleeve 13. Port 17 has a mechanical coupling 19 for bolting to the source of the first fluid. The second end of sleeve 13 receives a first partition 21 as shown more clearly in FIG. 2. Partition 21 is cup-shaped, having a cylindrical side wall portion and a convex inner end. "Convex" herein refers to a surface that protrudes outward, not being limited to the exterior of a sphere or curved surfaces. A circular rim 23 of partition 21 is of slightly lesser diameter than sleeve 13 and is sealed within sleeve 13 by conventional techniques such as crimping and soldering. As shown in FIG. 2, the convex inner end of partition 21 contains four inner tube holes 25, spaced in an even array around the longitudinal axis of the heat exchanger 11.

A second cylindrical sleeve 27 is adapted to slide closely over the convex portion of partition 21 and bump against the edge of sleeve 13. Sleeve 27 is of slightly larger diameter than the cylindrical portion of partition 21 and is sealed to partition 21 by conventional techniques. A second port 29 extends from the side wall of sleeve 27 and also contains a coupling 19. A second cup-shaped partition 31 has a cylindrical portion and a convex inner end, with its rim fitting into second sleeve 27 and being sealingly secured. Partition 31 contains two inner tube holes 33 and two outer tube holes 35 in its convex portion. Holes 33 and 35 are in axial alignment with the holes 25 in the first partition 21. Holes 35 are larger in diameter than holes 33 and are located above holes 33 in the preferred embodiment. Second port 17 is adapted to be coupled to the second fluid system.

A third cylindrical sleeve 37 having two open ends is closely received over the convex portion of partition 31. The edge of sleeve 37 bumps against the edge of second sleeve 27 and is sealed by conventional techniques to partition 31. A third port 39 extends outwardly from the side wall of sleeve 37. Port 39 has a coupling 19 for connection to the second fluid system. A third partition 41 has a cylindrical rim that is slidingly received a short distance in the second end of the third sleeve 37 and secured by conventional means. Partition 41 has a convex portion containing four outer tube holes 43 axially aligned with holes 25 in the first partition 21, and with holes 33 and 35 in the second partition 31.

A fourth cylindrical sleeve 45 fits slidingly over the convex portion of third partition 41, its open end bumping against the edge of third sleeve 27 and conventionally sealed to partition 41. A fourth port 47 extends from the side wall of sleeve 45. A conventional coupling 19 may be connected with port 47 for discharge into the first fluid return. Cap 49 closes the second end of the fourth sleeve 45.

As shown in FIG. 1 there are two outer tubes 51 having first ends 53 that extend a short distance through and are sealingly secured in the holes 35 in the second partition 31. Each of the outer tubes 51, referred to herein as "long" outer tubes, has a second end 55 that terminates in the fourth sleeve 45 a short distance in front of cap 49. The long outer tubes 51 pass sealingly through the two upper holes 43 in the third partition 41.

Two other outer tubes 57, referred to herein as "short" outer tubes, have the same diameter but are shorter in length than long outer tubes 56. Each short outer tube 57 has a first end 59 that is sealingly secured in one of the two lower holes 43 in the third partition 31. The first ends 59 terminate just inside of the third partition 41. Each short outer tube 57 has a second end 61 terminating below one of the second ends 55 of the long outer tubes 51 and at the same distance from cap 49.

Two crossover manifolds 63 are mounted to the second ends 55 and 61 of the outer tubes 51 and 57. Referring also to FIG. 2, each crossover manifold consists of a housing having an upper outer tube hole on its first side for sealingly receiving the second end 55 of a long outer tube 51. Each crossover manifold 63 also has a lower outer tube hole on its first side for sealingly receiving the second end 61 of one of the short outer tubes 57. The outer tube ends 55 and 61 extend slightly into the housing of the crossover manifold 63, which places one end 55 in fluid communication with one end 61. Crossover manifold 63 also prevents the second fluid from comingling with first fluid being discharged. Each crossover manifold 63 also has two inner tube holes 65 in its second side.

Four inner tubes 67 are carried in the heat exchanger, each concentrically within one of the outer tubes 51 or 57. All four inner tubes 67 have a first end 69 that extends sealingly a short distance through one of the holes 25 in the first partition.

Each inner tube 69 has a second end 71 that extends sealingly through one of the holes 65 in one of the cross over manifolds 63. Second end 71 terminates a short distance from cap 49. The two lower inner tubes 67, as shown in the drawing, pass sealingly through the two inner tube holes 33 in the second partition 31.

A square plate 73 is mounted to the fourth sleeve 45 near its connection with the third partition 41. If desired, sleeve 73 can be used to mount the heat exchanger to a tank containing first fluid. If so, the fourth sleeve 45 would be submerged in the tank, and a coupling 19 for port 47 would not be necessary. Sleeve 37 and all the components to the left of it, as shown in the drawing, would be located on the exterior of the tank.

In the preferred operation, as shown in FIG. 1, the liquid to be heated or chilled is pumped into the heat exchanger through the first port 17. As indicated by arrows 75, all of this first fluid is distributed to the four inner tubes 67 at their first ends 69. The first fluid flows through the length of the inner tubes 67, discharging at their second ends 71. All of the first fluid then flows back over the outer tubes 51 and 57, and out the fourth port 47 for use or for storage in a tank.

The heat transferring or second fluid, which often is steam, preferably enters a port on an upper side and discharges through a port on a lower side, to allow drainage of condensation. In the drawing, the second port 29 serves as the intake as indicated by the dashed arrows 77. All of the second fluid enters the ends 53 of the two long outer tubes 51, flows in the annular space surrounding inner tubes 67, and discharges into the crossover manifolds 63 at the second ends 55 of the long outer tubes 51. All of the second fluid flows down the crossover manifolds 63 and into the second ends 61 of the two short outer tubes 57. The second fluid then flows through the outer tubes 57 in the annular space around the inner tubes 67 and discharges at the first end 59 of the outer tubes 57. All of the second fluid proceeds out the third port 39 to the second fluid return.

The first fluid is heated by the second fluid as they flow through the inner and outer tubes, respectively. Further heat exchange takes place as the first fluid flows back over the walls of the outer tubes on its way to the fourth port 47.

In the drawing, the fourth sleeve 45 is shown to be relatively short, however in practice, it is considerably longer than the sleeves 13, 27 and 37. For example, it may be three or four feet long, while the cumulative length of the outer sleeves and the partitions may be only about eight or ten inches. Also, port 47 is located as close as is possible to the third partition 41. It is much closer to partition 41 than cap 49. This requires the first fluid to flow back over substantially all of the length of the short outer tubes 57, en route to the fourth port 47, to enhance heat exchange across the walls of the outer tubes.

In the preferred embodiment, first sleeve 13, second sleeve 27, and third sleeve 37 are identical. First partition 21, second partition 31 and third partition 41 are the same in size and configuration, and differ only in the size of the tube holes that they contain. Caps 15 and 49 are also identical. As shown in FIG. 2, the similarity of size and appearance allows a modular construction. Cap 15, sleeve 13, and partition 21 form the first module, which is also the intake manifold for first fluid. The second module, very similar in appearance, is comprised of the second sleeve 27 and the second partition 31. The second module in cooperation with the first partition 21 defines a manifold for second fluid. The third module, similar in appearance to the other modules, comprises the third sleeve 37 and the third partition 41. The third module in cooperation with the second partition 31, defines another manifold for second fluid. The fourth module resembles the other modules in construction, however, it is considerably longer, and consists of the fourth sleeve 45 and cap 49. The fourth module in cooperation with the third partition 41, defines the first fluid discharge manifold. During assembly, the modules slide easily together and can be sealed by conventional soldering and other techniques.

It should be apparent that an invention having significant advantages has been provided. The separate modules, which nest or slide upon each other, allow interchange of components, thus reducing the cost. The forming of the partitions can be by die stamping if a ductile metal such as copper is used.

While the invention has been shown in only one of its forms, it should be apparent that it is not so limited, but is susceptible to various improvements and modifications thereof.

I claim:

1. An apparatus for exchanging heat between two fluids, comprising in combination:

a first cup-shaped module having a first port for the passage of a first fluid, the first module having an inner end containing two inner tube holes;

a second cup-shaped module with a rim on its outer end that sealingly receives the inner end of the first module, the second module having a second port on its side wall for the passage of a second fluid, and an inner end that has an inner tube hole and an outer tube hole;

a third cup-shaped module with a rim on its outer end that sealingly receives the inner end of the second module, the third module having a third port on its side wall for the passage of the second fluid, and an inner end that has two outer tube holes;

a fourth cup-shaped module with a rim on one end that sealingly receives the inner end of the third module, the other end of the fourth module being closed, the fourth module having a fourth port on each side wall for the passage of the first fluid;

a long outer tube having a first end sealingly secured to the outer tube hole in the second module, extending sealingly through one of the outer tube holes in the third module, and a second end terminating adjacent the closed end of the fourth module;

a short outer tube having a first end sealingly secured to the other outer tube hole in the third module, and a second end terminating adjacent the second end of the long outer tube;

a crossover manifold communicating the second ends of the outer tubes, to cause second fluid flowing from the first end to the second end of one outer tube to enter and flow from the second end to the first end of the other outer tube, the crossover manifold having two inner tube holes; and two inner tubes, each carried concentrically in one of the outer tubes, each having a first end sealingly secured to one of the inner tube holes in the first module, each having a second end sealingly secured to one of the inner tube holes in the crossover manifold, one of the inner tubes sealingly passing through the inner tube hole in the second module, the first fluid moving through the inner tubes between the first and fourth ports, exchanging heat with the second fluid as it moves through the outer tubes between the second and third ports.

2. The apparatus according to claim 1 wherein the first port serves as an intake for the first fluid, and the fourth port serves as a discharge for the first fluid.

3. The apparatus according to claims 1 or 2 wherein the second port serves as an intake for the second fluid and the third port serves as a discharge for the second fluid.

4. An apparatus for exchanging heat between two fluids, comprising in combination:

a first sleeve having a closed end and an open end and containing a first port for the passage of a first fluid;

a first partition having a convex end with two inner tube holes, and another end being a rim sealingly secured within the first sleeve;

a second sleeve having two open ends and a second port in its side wall for the passage of a second fluid, the convex end of the first partition being sealingly secured within the second sleeve;

a second partition having a convex end with an inner tube hole and an outer tube hole, and another end being a rim sealingly secured within the second sleeve;

a third sleeve having two open ends and a third port in its side wall for the passage of the second fluid, the convex end of the second partition being sealingly secured within the third sleeve;

a third partition having a convex end with two outer tube holes, and another end being a rim sealingly secured within the third sleeve;

a fourth sleeve having an open end and a closed end, the fourth sleeve having a fourth port in its side wall for the passage of the first fluid, the convex end of the third partition being sealingly received within the open end of the fourth sleeve;

a long outer tube having a first end sealingly secured to the outer tube hole in the second partition, and a second end terminating in the fourth sleeve adjacent the closed end of the fourth sleeve, the long outer tube sealingly passing through one of the outer tube holes in the third partition;

a short outer tube having a first end sealingly secured to the other outer tube hole in the third partition, and a second end terminating in the fourth sleeve adjacent the second end of the long outer tube;

a crossover manifold communicating the second ends of the outer tubes to cause second fluid to flow from the second end of one outer tube to the second end of the other outer tube; the crossover manifold having two inner tube holes; and a pair of inner tubes, each passing concentrically through one of the outer tubes, each having a first end sealingly secured to one of the inner tube holes in the first partition, each having a second end sealingly secured to one of the inner tube holes in the crossover manifold, one of the inner tubes sealingly passing through the inner tube hole in the second partition, the first fluid passing through the inner tubes between the first port and fourth port, exchanging heat with the second fluid as it passes through the outer tubes between the second port and third port, the fourth port being located substantially closer to the third partition than to the closed end of the fourth sleeve, so as to cause the first fluid to flow in the fourth sleeve substantially over the entire length of the short outer tube.

5. The apparatus according to claim 4 wherein the closed end of the first sleeve is a cap sealingly secured over one end of the first sleeve.

6. The apparatus according to claim 5 wherein the first port is located in the side wall of the first sleeve.

7. The apparatus according to claim 6 wherein the first, second, and third sleeves are identical.

8. The apparatus according to claims 4 or 7 wherein the first, second, and third partitions differ only in the size of the holes that they contain.

9. An apparatus for exchanging heat between two fluids comprising in combination:

a first sleeve having a cap secured to one end, the other end being open, the first sleeve having a first port on its side wall for the intake of first fluid;

a first partition having a convex end containing four inner tube holes, and another end being a rim sealingly received within the first sleeve for defining a first fluid intake manifold between the cap and the first partition;

a second sleeve having two open ends and a second port in its side wall for the passage of second fluid, the convex end of the first partition being sealingly received within the second sleeve;

a second partition having a convex end with two inner tube holes and two outer tube holes, and another end being a rim sealingly received within the second sleeve for defining a second fluid manifold between the first and second partitions;

a third sleeve having two open ends and a third port in each side wall for the passage of the second fluid, the convex end of the second partition being sealingly received within the third sleeve;

a third partition having a convex end with four outer tube holes, and another end being a rim sealingly received within the third sleeve for defining another second fluid manifold between the second and third partitions;

a fourth sleeve having a cap secured to one end, the other end being open, the fourth sleeve having a fourth port on its side wall for the discharge of the first fluid, the convex end of the third partition being sealingly received within the open end of the fourth sleeve for defining a first fluid discharge manifold between the third partition and the cap of the fourth sleeve;

two long outer tubes, each having a first end sealingly secured to one of the outer tube holes in the second partition, placing their first ends in fluid communication with the second manifold, each having a second end terminating adjacent the cap of the fourth sleeve, each of the long outer tubes sealingly passing through one of the outer tube holes in the third partition;

two short outer tubes, each having a first end sealingly secured to the other outer tube hole in the third partition, placing their first ends in fluid communication with the second manifold, each having a second end terminating in the fourth sleeve adjacent the second ends of the long outer tubes;

crossover manifold means, communicating the second ends of the long outer tubes with the second ends of the short outer tubes for causing all of the second fluid to flow between the long and short outer tubes, the crossover manifold means having two inner tube holes; and four inner tubes, each passing concentrically through one of the outer tubes, each having a first end sealingly secured to one of the inner tube holes in the first partition, placing their first ends in fluid communication with the first fluid intake manifold, each having a second end sealingly secured to one of the inner tube holes in the crossover manifold means, placing their second ends in fluid communication with the first fluid discharge manifold;

the first, second and third sleeves being substantially the same in configuration, with the fourth sleeve being longer in length, the fourth port being located closer to the first end of the short outer tubes than to the second end of the short outer tubes to cause first fluid to flow over the short and long outer tubes substantially the length of the short outer tubes, the first, second and third partitions being substantially the same in configuration except for the holes that they contain.

10. The apparatus according to claim 9 wherein the second port serves as the intake for second fluid, and the third port serves as the discharge for second fluid.

* * * * *